United States Patent [19]

Finsterwalder

[11] Patent Number: 4,766,861

[45] Date of Patent: Aug. 30, 1988

[54] IGNITION DEVICE FOR AIR-COMPRESSING INTERNAL COMBUSTION ENGINE

[75] Inventor: Gerhard Finsterwalder, Bergisch Gladbach, Fed. Rep. of Germany

[73] Assignee: Kloeckner-Humboldt-Deutz AG, Fed. Rep. of Germany

[21] Appl. No.: 96,898

[22] Filed: Sep. 14, 1987

[30] Foreign Application Priority Data

Sep. 16, 1986 [DE] Fed. Rep. of Germany ..... 3631444

[51] Int. Cl.[4] ..... F02B 19/12

[52] U.S. Cl. ..... 123/254; 123/143 B; 123/145 A; 123/266

[58] Field of Search ..... 123/143 B, 145 A, 169 PA, 123/169 PH, 254, 255, 266, 269; 313/143

[56] References Cited

U.S. PATENT DOCUMENTS

| | | | |
|---|---|---|---|
| 1,223,124 | 4/1917 | Thompson | 123/145 A |
| 2,456,080 | 12/1948 | Pe | 123/254 X |
| 4,182,281 | 1/1980 | Heintzelman | 123/266 |
| 4,305,357 | 12/1981 | Scherenberg et al. | 123/254 |

FOREIGN PATENT DOCUMENTS

| | | | |
|---|---|---|---|
| 3145339 | 5/1983 | Fed. Rep. of Germany | 123/266 |

*Primary Examiner*—Tony M. Argenbright

*Attorney, Agent, or Firm*—Charles L. Schwab

[57] ABSTRACT

An ignition device for an air-compressing internal combustion engine which, in addition to reducing electrode erosion, requires low energy consumption. The ignition device includes a high-voltage spark plug (2) to which a casing (6) is connected, a rod (8) inserted coaxially into the casing (6) and an incandescent helix (11) wound around the rod (8).

3 Claims, 1 Drawing Sheet

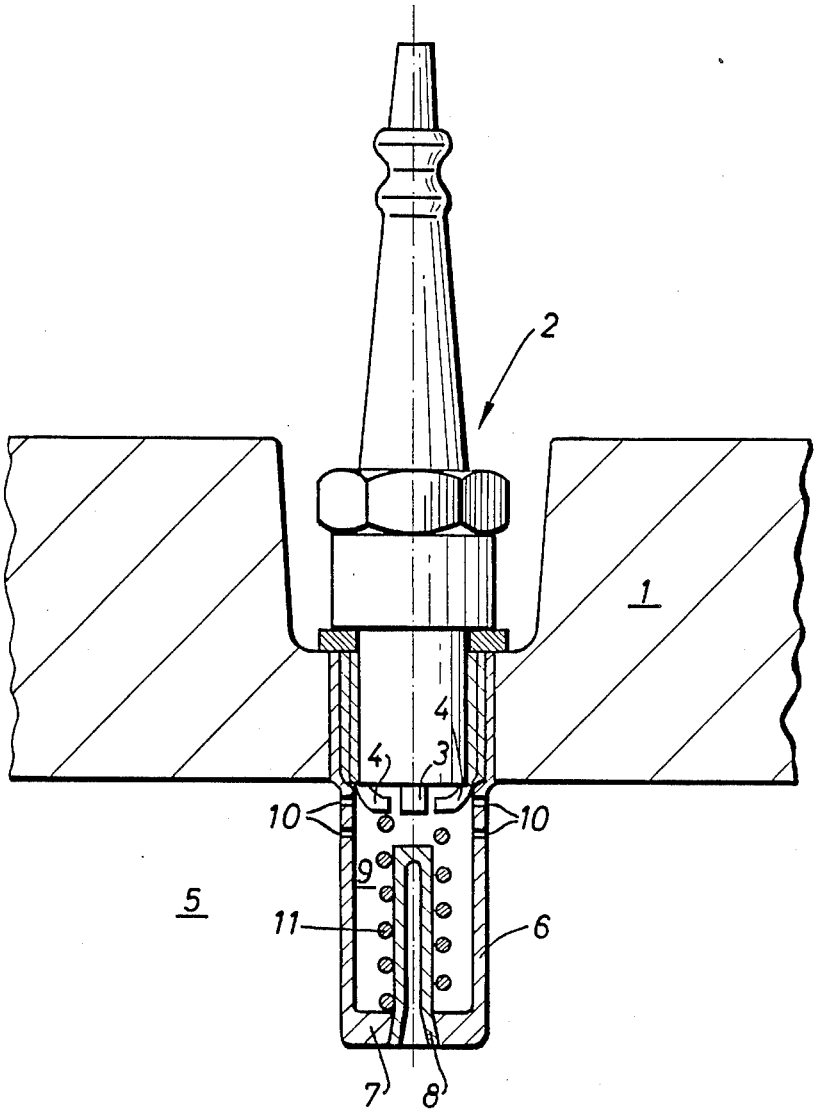
2
1
4
4
3
10
10
9
5
11
6
7
8

IGNITION DEVICE FOR AIR-COMPRESSING INTERNAL COMBUSTION ENGINE

TECHNICAL FIELD

This invention pertains to an ignition device for an air-compressing internal combustion engine.

PRIOR ART STATEMENT

As shown in DD-PS 39 916, it is well known to use an injection nozzle to inject fuel into the combustion chamber in the piston of an air-compressing internal combustion engine. In order to ignite the fuel/air mixture in the combustion chamber, an ignition device is provided which includes a spark plug having a casing which surrounds at least the electrodes of the spark plug and which has openings in its surface. By providing the casing, the cooling off of the ignition source due to the combustion air flowing past it and/or by its being impacted by streams of fuel, is reduced. This prior art ignition device has the disadvantage that the ignition chamber which is formed by the casing cools off at the spark plug to such a great extent because of the entering fuel (in spite of the partial shielding) that, especially during operation of the engine with ignition-resistant fuels, the source of ignition must be kept on constantly during operation so that a quantity of heat is produced which is sufficient for vaporization and/or for igniting the impacting streams of fuel. In addition to the disadvantage involved in having to constantly supply electrical energy (the reduction of the net efficiency of the internal combustion engine), constant operation leads to a correspondingly higher degree of spark plug electrode scaling loss which reduces the service life of the spark plug.

OBJECTS AND SUMMARY OF THE INVENTION

A primary object of this invention is to make available an ignition device for an air-compressing internal combustion engine which provides good ignition of the fuel injected into the combustion chamber, does not deteriorate at high temperatures and functions properly under all operating conditions of the engine, whereby the deterioration of the ignition device and the consumption of electrical energy by ignition device is minimized.

In order to achieve the foregoing objective, this purpose is met by the fact that at the inner or combustion chamber side of the casing, an inner reinforcement wall is provided from which a rod extends inwardly within the casing toward the electrode. A wire helix is would around the rod and is supported between the inner reinforcement of the casing and the mass or shell electrode of the spark plug, which is a high-voltage spark plug. It has been shown that, using this invention, the electrical energy supplied to the ignition device can be considerably reduced. If, for example, the ignition unit which is preferably designed as a high-voltage buzzer ignition is switched on when the internal combustion engine is started up, the plug electrodes heat up rapidly because of the continuous spark. In this way the fuel/air mixture which is forced into the combustion chamber is ignited and in turn heats the incandescent helix and the rod which extends coaxially at least partially into the incandescent helix. Because of the concurrent use of the incandescent helix and the rod as heat reservoirs, the high-voltage spark plug need only be switched on during start-up or following a changed operating condition of the internal combustion engine.

BRIEF DESCRIPTION OF THE DRAWING

One embodiment of the invention is illustrated in the drawing which is a section view of an ignition device.

DETAILED DESCRIPTION OF THE DRAWING

Referred to the drawing, a high-voltage spark plug 2, which is the ignition source, is screwed into the cylinder head 1. The high-spark plug extends downwardly from the cylinder head 1 so that the electrodes 3, 4 are disposed within the combustion chamber 5 of the internal combustion engine. The electrode 3 and the mass or shell electrode 4 are high-voltage electrodes. In addition, at the high-voltage spark plug 2 a casing 6 is fastened by, for instance, a screw fitting. The casing 6 extends into the combustion chamber 5 and is provided at its bottom or combustion chamber end with an end wall or inner reinforcement 7, at which a rod 8 is secured coaxially to the casing 6. The rod 8 extends into the interior of the casing 6 and terminates a predetermined distance from and in confronting relation to the central electrode 3. The ignition chamber 9, which is formed by the casing 6 and the rod 8, is connected with the combustion chamber 5 of the internal combustion engine by boreholes 10 which are formed in the outer circumference of casing 6 in the portion thereof which is near the cylinder head. In addition, an incandescent helix 11 is wound around the rod 8 and is supported at its opposite ends on the inner reinforcement 7 and the shell electrode 4 of the high-voltage spark plug 2. The incandescent helix 11 is preferably made of oxidize resistant wire which is 0.5 to 1.0 mm thick. The rod 8, as illustrated, is formed as a hollow rod with a closed upper or free end confronting the central electrode 3.

The high-voltage spark plug 2 is preferably switched on and off by means of a signal device which is coupled with the control bar of the fuel supply pump and transmits a signal to a control mechanism as soon as the control rod is set to deliver fuel. In addition to this, a signal representing the exhaust gas temperature of the internal combustion engine is transmitted to the control mechanism via a temperature measuring sensor. Both of the measured parameters are processed in the control mechanism in such a way that electrical energy is provided to the high-voltage ignition device upon simultaneous signalling that a specifiable exhaust gas temperature is not exceeded and the control rod is in its fuel delivery operational setting.

Through this development the spark plug functions only for a short time and with relatively cool electrodes 3, 4 so that, in addition to low energy consumption, deterioration of the electrodes of the high-voltage spark plug 2 is minimized and the service life of the high-voltage spark plug 2 is correspondingly increased. The high-voltage spark plug 2 is preferably supplied by a high-voltage buzzer ignition, whereby each high tension spark plug is provided with an ignition coil which is integrated into the spark plug socket, which can be connected in parallel on the low tension side -- corresponding to the number of high-voltage spark plugs 2 which are in an internal combustion engine -- and spark simultaneously without an ignition distributor.

The embodiments of the invention in which an exclusive property or privilege is claimed are defined as follows:

1. An ignition device for an air-compressing internal combustion engine having a combustion chamber, said ignition device comprising: a high voltage spark plug serving as the source of fuel ignition including a shell electrode extending into said combustion chamber, a casing surrounding said electrode and presenting at least one fuel inlet opening, said casing including a wall disposed within said combustion chamber, a rod secured to said wall and extending into the interior of said casing and an incandescent helix coiled about said rod and supported at one of its ends on said wall and at the other of its ends on said shell electrode of said spark plug.

2. The ignition device of claim 1 wherein said rod has a hollow chamber which is open to said combustion chamber.

3. The ignition device of claim 2 wherein said hollow chamber is substantially coextensive with the length of said rod.

* * * * *